United States Patent [19]

Metcalf

[11] Patent Number: 4,539,105

[45] Date of Patent: Sep. 3, 1985

[54] CYCLONE SEPARATOR HAVING ABRASION RESISTANT CONE COVERED BY A PLASTIC SLEEVE WITH FLEXIBLE SEAL REGIONS

[75] Inventor: Robert L. Metcalf, Beaverton, Oreg.

[73] Assignee: Wilbanks International, Inc., Hillsboro, Oreg.

[21] Appl. No.: 553,320

[22] Filed: Nov. 17, 1983

[51] Int. Cl.[3] ..... B04C 5/28

[52] U.S. Cl. ..... 209/211; 55/349; 156/84; 210/512.2

[58] Field of Search ..... 55/52, 349, 435; 138/141; 156/294, 84; 209/144, 211; 210/512.2

[56] References Cited

U.S. PATENT DOCUMENTS

| | | | |
|---|---|---|---|
| 2,963,045 | 12/1960 | Canevari et al. | 138/141 |
| 2,974,684 | 3/1961 | Ginavan et al. | 209/211 X |
| 3,315,348 | 4/1967 | Donovan et al. | 156/294 X |
| 4,285,706 | 8/1981 | Dehne | 55/349 X |

*Primary Examiner*—Charles Hart

*Attorney, Agent, or Firm*—Klarquist, Sparkman, Campbell, Leigh & Whinston

[57] ABSTRACT

Cyclone separator apparatus and method of manufacture are described for providing a separator cone of abrasion resistant material covered by a sleeve of plastic material having flexible seal regions at least some of which are spaced from the outer surface of the cone. The cover sleeve of plastic is bonded to the cone of abrasion resistant material which is preferably made of aluminum oxide ceramic material, by heating the cone to a temperature above the melting temperature of the plastic, inserting the heated cone into the sleeve to melt the inner surface of the sleeve and cooling the assembly below such melting temperature to bond the sleeve to the cone. The sleeve may be made of polyethylene or other suitable thermoplastic or thermosetting plastic materials and the cleaner cone can be made of ceramic material, metal or other suitable abrasion resistant materials of high melting temperature than the plastic sleeve. As a result of the flexible seal regions formed by circular ridge projections on the outer surface of the plastic sleeve, the cyclone cleaner cone can be inserted through three mounting apertures in the walls of pressure chambers and sealed to wall flanges surrounding the apertures even though such apertures are not in exact alignment and the cleaner cone is not exactly symmetrical.

10 Claims, 6 Drawing Figures

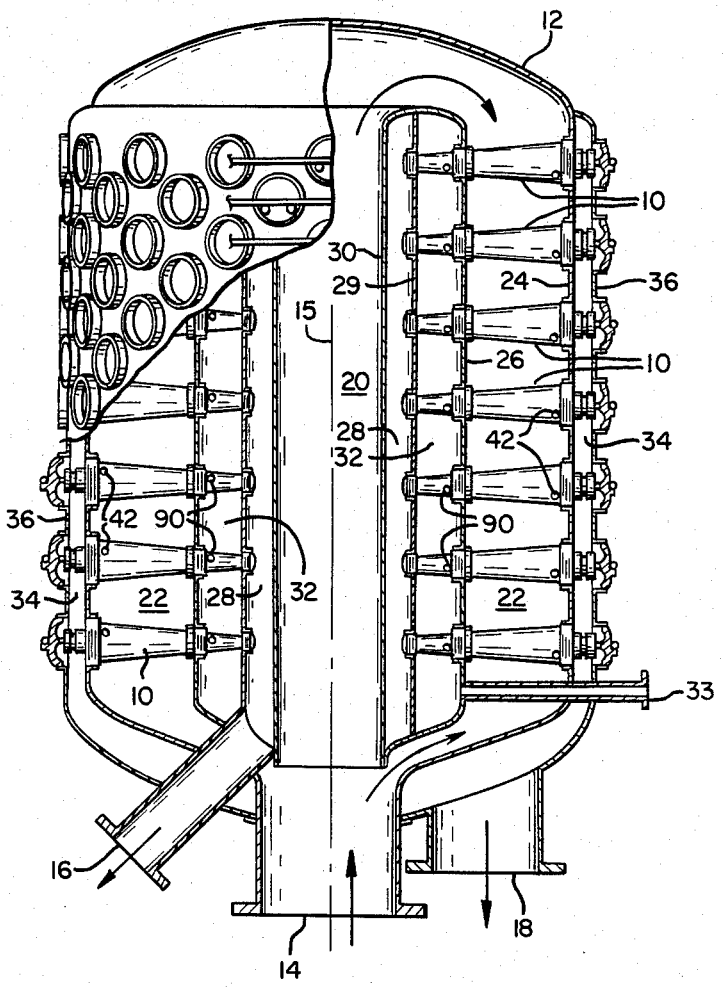
FIG. 1
FIG. 3
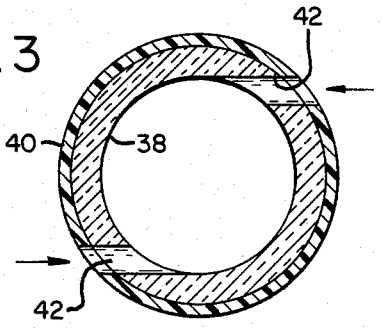
FIG. 4
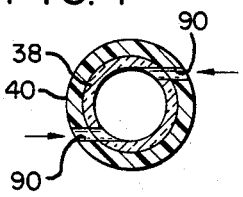

CYCLONE SEPARATOR HAVING ABRASION RESISTANT CONE COVERED BY A PLASTIC SLEEVE WITH FLEXIBLE SEAL REGIONS

BACKGROUND OF THE INVENTION

The subject matter of the present invention relates generally to cyclone separator apparatus and method of manufacture for such apparatus. In particular, the invention relates to cyclone separator cone apparatus and method of making including a cone of abrasion resistant material which is bonded to a cover sleeve of plastic material that is provided with a plurality of flexible seal regions The flexible seal regions include circular ridge projections on the outer surface of the seal regions, at least some of such seal regions being spaced away from the outer surface of the cone for greater flexibility.

The separator cone apparatus of the present invention may be used to separate heavy fraction material and light fraction material from any liquid, but is especially useful for cleaning foreign matter including solid particles and heavy fraction reject material from a paper pulp slurry. The present invention enables such separator cones to be sealed in apertures provided through the walls of at least three separate pressure chambers even though such apertures are not in exact axial aligment, and the cones are out of round and not exactly symmetrical so that the seal regions are not in perfect alignment. Each cone has an inlet for tangentially injecting stock liquid into the cone from a liquid stock supply chamber of high pressure. A heavy fraction outlet is provided at the small end of the cone normally from a reject chamber of intermediate pressure, and a light fraction outlet is provided at the large end of the cone normally connected to an accept chamber of lower pressure. A water supply chamber may also be connected to a water inlet adjacent the small end of the cone between the stock chamber and the reject chamber, for thinning thickened stock. This frees acceptable fiber from rejects and prevents eccessive stock loss.

As shown in U.S. Pat. No. 3,486,618 of Wikdahl issued Dec. 20, 1969 and U.S. Pat. No. 3,959,123 of Wikdahl issued May 25, 1976, it is old to provide a canister type of hydrocyclone separator unit with a plurality of rows of cyclone cleaner cones which are mounted by seals in apertures provided through the walls of pressure chambers. Previously, it has been conventional to provide resilient rubber gaskets around the cone to form the seals between the cleaner cone and the pressure chamber walls. While such rubber gasket seals can be compressed, they cannot move laterally sufficiently to seal a non-symmetrical cone and/or non-aligned mounting apertures in the pressure chamber walls. Thus, sometimes the cone is made out of round or non-symmetrical and the mounting apertures are not concentric but are laterally offset from the axis of the cone, which presents a difficult sealing problem. In order to attempt to accommodate some axial misalignment of the apertures or non-symmetry of the cone, the sealing gaskets are sometimes made large enough to cover a small amount of lateral offset of the aperture relative to the cone axis. However, the sealing gasket seal must be soft enough to compress sufficiently to seal the small axially misalignment of a mounting aperture without resulting in too great a pressure which might break the cleaner cone when it is made of ceramic material. Of course, any seal must be sufficiently strong to withstand the pressure encountered in the chambers which are coupled to the inlet and outlets of the cone. Therefore, such rubber gaskets frequently cannot form adequate seals when there is any appreciable axial misalignment of the mounting apertures or non-symmetry of the cone.

U.S. Pat. No. 3,800,946 of Reid et al issued Apr. 2, 1974 shows a hydrocyclone including cyclone cleaner cones made of polyurethane plastic material which is provided with sealing ridges formed integral with the outer surface of such cleaning cone. However, such plastic cleaning cone is of great thickness to withstand the pressure of the liquid cyclone produced within the cone so that the seals provided on its outer surface are not flexible. This prevents sealing when the apertures in the support walls are not in alignment or the cone is not symmetrical about its axis. In addition, the cone wears out relatively quickly due to abrasion compared to the long useful life of a ceramic cone. These problems are avoided in the present invention by providing a thin plastic cover sleeve with flexible seal regions covering the outer surface of a cleaner cone of abrasion resistant material, such as ceramic, which is harder than the sleeve and is of a higher melting temperature.

U.S. Pat. No. 3,747,306 of Wikdahl issued July 24, 1973 shows cyclone cleaner cones made of ceramic material. However, there is no cover sleeve of plastic material bonded to the outer surface of such cone. Also, there is no plastic cover sleeve provided with flexible seal regions spaced from the outer surface of the cone and including sealing ridges formed on the outer surface of such sealing regions in the manner of the present invention. Instead, the ceramic cone member is provided with ridges on its outer surface which apparently forms a seal with a surrounding resilient sealing member such as a rubber gasket between the cone and the mounting apertures in the pressure chamber walls.

U.S. Pat. No. 4,053,393 of Day et al issued Oct. 11, 1977 shows a cyclone cleaner cone apparatus having a composite cone including a ceramic cone portion joined by interengaging projections to an elastomer cone portion made of polyurethane or other suitable plastic material, such composite cone being covered by a housing apparently made of metal. In one embodiment, the ceramic cone portion is inserted within an elastomer sleeve or liner which also forms the plastic cone portion. However, such sleeve is not provided with any sealing regions much less flexible sealing regions including annular projections or ridges in the manner of the present invention at least some of which are spaced from the outer surface of the ceramic cone. Indeed, a metal housing surrounds the composite cone and sleeve which apparently precludes any seals from being formed between flexible seal regions on the sleeve and a surrounding mounting wall aperture in the manner of the present invention.

SUMMARY OF THE INVENTION

It is therefore one object of the present invention to provide an improved cyclone separator apparatus and method of manufacture for providing a separator cone of abrasion resistant material covered by a sleeve of plastic material having flexible seal regions thereon to form high pressure seals when mounted in wall apertures which are not in exact alignment or with an out of round cone which is not completely symmetrical.

Another object of the invention is to provide such a cyclone separator apparatus and method in which the cover sleeve of plastic is bonded to the cone of abrasion resistant material in a simple and effective manner by heating the cone to a temperature above the melting temperature of the plastic and inserting the heated cone into the plastic to melt the inner surface of the sleeve, and thereafter cooling the assembly below the melting temperature to bond the sleeve to the cone.

A further object of the present invention is to provide such a cyclone separator apparatus in which the flexible seal regions of the plastic sleeve are spaced from the outer surface of the separator cone to provide greater flexibility and have sealing ridges projecting from the outer surface of the sealing ridges to provide high pressure seals of great strength for mounting in the walls of pressure chambers connected to the interior of the cone.

An additional object of the invention is to provide such a cyclone separator apparatus in which the cone is made of abrasion resistant material of greater hardness than the plastic sleeve and of higher melting temperature than such sleeve to provide better wear characteristics and longer useful lifetime as well as enabling the plastic sleeve to be bonded to the cone by melting the surface of such sleeve.

Still another object of the cyclone separator apparatus of the present invention is to provide the cone of ceramic material and/or to provide such sleeve of polyethylene plastic material.

A still further object of the present invention is to provide a method for bonding a plastic sleeve to a core member of higher melting temperature material in a simple and economic manner by heating the core member to the melting temperature of the plastic sleeve and inserting the heated core member into the sleeve to melt the inner surface of the sleeve and thereafter cooling the assembly below the melting temperature of the plastic to cause bonding.

DESCRIPTION OF DRAWINGS

Other objects and advantages of the present invention will be apparent from the following detailed description of a preferred embodiment thereof and from the attached drawings of which:

FIG. 1 is a side elevation view of a cyclone separator apparatus employing a plurality of separator cone assemblies made in accordance with the present invention, with parts broken away for clarity;

FIG. 3 is a vertical section view taken at the stock inlet along the line 3—3 of FIG. 2;

FIG. 4 is a vertical section view taken at the water inlet along the line 4—4 of FIG. 2;

DESCRIPTION OF PREFERRED EMBODIMENT

Figure 2:
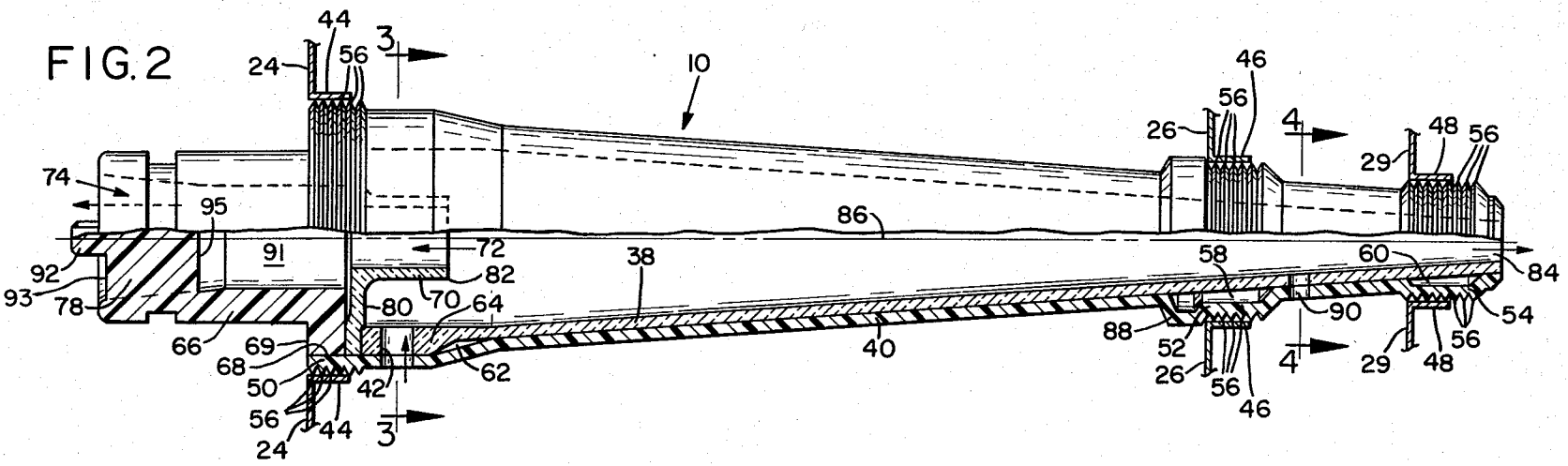
FIG. 2 is an enlarged front elevation view of the separator cone assembly of the present invention with the lower half broken away for clarity.

As shown in FIG. 1, the cyclone separator apparatus may be of the canister type which includes a plurality of separator cone assemblies 10 made in accordance with the present invention which are mounted in vertical rows within a cyclone separator housing 12. The housing has a stock inlet pipe 14 extending upward through the bottom of the housing coaxial with the vertical axis 15 of such housing. A heavy fraction discharge or reject outlet pipe 16 and a light fraction discharge or accept outlet pipe 18, are also provided in the bottom of the housing on opposite sides of the stock inlet pipe. The stock inlet pipe 14 feeds liquid stock, such as paper pulp slurry solution, into the bottom of a central chamber 20 and a stock inlet chamber 22 surrounding such central chamber, at high pressure on the order of approximately 25 psi gauge pressure. The top end of the central chamber 20 is connected to the top of the stock inlet chamber 22 so that liquid stock enters the top and bottom of such inlet chamber. The stock inlet chamber 22 is formed by an outer chamber wall 24 and an inner wall 26 spaced radially inward from the outer wall towards the center axis 15 of the housing 12. A plurality of rows of separator cone assemblies 10 are mounted with their longitudinal axes extending radially inward toward the center axis 15 of the housing 12 and substantially horizontal by mounting such cone assemblies within pairs of aligned circular mounting apertures in the chamber walls 24 and 26.

A heavy fraction discharge or reject chamber 28 is provided between chambers 20 and 22 and is connected to each vertical row of cone assemblies 10 at the small diameter outlet ends of such cone assemblies. This reject chamber is an annular chamber bounded by an outer chamber wall 29 and an inner wall 30 which is spaced radially inward from wall 29. The reject chamber 28 is connected at its inlets to the reject outlet at the apex or small diameter end of each of the cone assemblies and is connected to the reject outlet pipe 16. Thus, heavy fraction liquid separated from the stock within the cone assemblies is discharged into reject chamber 28 and out through outlet pipe 16, such heavy fractional material containing solid particles of sand or other abrasive particles such as pulp stone grit of aluminum oxide or silicon carbide when the stock is a solution of paper pulp formed by pulp stone grinding.

A water inlet chamber 32 may be provided between the reject outlet chamber 28 and the stock inlet chamber 22, such water inlet chamber being an annular chamber formed between chamber walls 26 and 29. The water inlet chamber is connected by a water supply pipe 33 to a source of water which is injected into the separator cone assembly 10 through the wall of the separator cone adjacent its small end in the region between chamber walls 26 and 29, in a manner hereafter described with respect to FIG. 4. This water injection is optionable. The addition of water dilutes the stock and allows the reject particles to separate from the pulp fiber more freely. This enhances the cleaning action of the cyclone and saves stock that might otherwise be lost with the reject particles.

A light fraction or discharge accept output chamber 34 connected to the large diameter end of the cone assemblies is provided between chamber wall 24 and an outermost chamber wall 36 which forms the side of the cyclone separator housing 12. This accept chamber 34 receives light fraction material separated from the liquid stock in the cone assemblies and discharged from the accept outlet at the large end of each cone. The accept chamber 34 communicates with the accept outlet 18 of the housing to discharge the acceptable paper pulp solution out of the separator apparatus.

As shown in FIG. 2, the separator cone assembly 10 of the present invention includes a hollow separator cone 38 of abrasion resistant material including metal such as stainless steel or ceramic material such as aluminum oxide ceramic material, which may be 18.85 inches long with a wall thickness of about 0.150 to 0.250 inch thick. However, other metals and ceramic material can be employed including silicone carbide ceramic. The cone 38 is covered by a cover sleeve 40 of plastic material, such as linear polyethylene or other thermoplastic materials including nylon and polyurethane, which is 19.75 inches long and has a wall thickness of about 0.150 to 0.200 inch thick. In addition, a thermosetting plastic material may be employed for the sleeve, such as acrylonitrile butadiene styrene (ABS) or polyvinyl chloride (PVC) plastic. Also, it is possible to make the cone 38 as a composite cone with a large diameter portion of plastic such as polyurethane or nylon and smaller diameter portion of ceramic covered by the cover sleeve 40 of plastic such as polyethylene bonded thereon. One such composite cone is shown in U.S. Pat. No. 4,053,393 of Day et al discussed above.

A pair of stock inlet passages 42 of 0.520 inch diameter are provided through the side wall of the cover sleeve 40 and hollow cone 38 adjacent the large diameter end thereof which has an outer diameter of 4.225 inches. These inlet passages 42 each inject liquid stock solution into the cone in a direction tangential to the inner surface of the cone at high pressure on the order of about +25 psi gauge. The stock solution is supplied in the stock chamber 22 between the chamber walls 24 and 26 which are provided with a plurality of aligned pairs of cone assembly mounting openings surrounded by metal flanges 44 and 46, respectively. The flanges 44 and 46 are circular cylinders extending substantially perpendicular to the walls 24 and 26 surrounding the mounting openings. Aligned with each pair of openings in flanges 44 and 46 is a third mounting opening provided in the reject chamber wall 29 surrounded by a circular flange 48 extending perpendicular to such wall. Each cone assembly is mounted in the three aligned openings by seals as hereafter described.

Three longitudinally spaced plastic seal regions 50, 52 and 54 are formed in the plastic cover sleeve 40 which have outer diameters of 4.525, 2.575 and 2.000 inches, respectively. The seal regions 50, 52 and 54 are each provided with a plurality of annular sealing ridges or projections 56 extending from the outer surface of such seal regions which form high pressure seals by frictional engagement with the inner surfaces of flanges 44, 46 and 48, respectively, whose inner diameters are about 0.005 to 0.010 inches less than the outer diameters of their associated seal regions to provide an interference fit. Thus, the seal regions 50, 52 and 54 together with the sealing ridges 56 form with the flanges 44, 46 and 48 flexible seals which are capable of withstanding high pressure up to at least 45 psi gauge. These high pressure seals prevent liquid stock from leaking through seals 50 and 52 from the stock chamber 22 into the accept chamber 34 or the water chamber 32, and also preventing water from leaking from the water chamber through seals 52 and 54 into the stock chamber 22 or the reject chamber 28. It should be noted that the reject chamber 28 is normally at a pressure of about +10 psi gauge which is much lower than the 25 psi pressure of the stock chamber or the water chamber, while the accept chamber is at even lower pressure on the order of about +9 psi gauge pressure. The seal regions 52 and 54 are spaced from the outer surface of the cone 38 by annular air spaces or gaps 58 and 60 about 0.200 inch wide which further increases the flexibility of such seal regions in the event the mounting openings of flanges 46 and 48 are not in exact alignment with the opening of flange 44. In addition, for ease of assembly there is a circular clearance space 62 between the sleeve 40 and the cone 38 in the region adjacent the inlet 42 immediately to the right of the thickened lip portion 64 of the cone at the large diameter end of such cone.

A cap member 66 about 4.50 inches long of plastic material, such as linear polyethylene, similar to that of the cover sleeve 40 is bonded within the large diameter end of such cover sleeve by a heat seal "weld" 68 formed by selectively melting the outer surface of the cap base 69 and the inner surface of such end of the sleeve to bond them together at the heat weld. A vortex finder member 70 of abrasion resistant material, such as ceramic matching that of the cone 38, is mounted to close the large diameter end of such cone by clamping it between the large ends of the cone and the cap member 66 when such cap member is heat sealed to the cover sleeve. The vortex finder 70 is provided with a light fraction discharge or accept outlet passage 72 which communicates with the accept chamber 34 through a pair of cap outlet openings 74 and 76 at the left end of the cap member 66 which are separated by a divider partition 78 in such cap member. Thus, the accept outlet passage 72 of the vortex finder member 70 discharges light fraction material separated from the liquid stock in the separator cone 38 from such cone into the accept chamber 34 through the outlets 74 and 76 in the cap 66. The vortex finder 70 includes a flat annular base portion 80 which is formed integral with a circular cylinder portion 82 extending perpendicular to such base portion. The cylindrical portion 82 surrounds the outlet passage 72 and has an inner diameter of about 1.06 inch which is slightly greater than the outer diameter of the air or gas vortex formed within the cone 38 in alignment with axis 15 by the swirling action of the cyclone of liquid stock as it travels from left to the right in FIG. 2 down along the surface of the cone from the large diameter end to the small diameter end of the cone.

At the small diameter end of the cone, heavy fraction materials including solid particles separated from the liquid stock are discharged into the reject chamber 28 through a reject outlet passage 84 provided by the inner surface of the small end of the cone having a diameter of about 0.730 inch. The heavy fraction portion of the stock liquid together with any solid particles in the stock tend to concentrate adjacent the inner surface of the cone due to centrifugal force and to spiral downward toward the reject outlet passage 84. At the same time, a gas vortex is produced in the center of the liquid cyclone in alignment with the longitudinal axis 86 of the separator cone 38 by air leaking into the cone at outlets 72 and 84 from the accept and reject chambers 34 and 28 which are open to the atmosphere. This gas vortex spirals upward in the cone from the reject outlet 84 towards the light fraction accept outlet passage 72 and is confined within the cylinder portion 82 of the vortex finder 70. As a result, light fraction liquid material is separated from the stock liquid and carried outward through the accept outlet passage 72 and into the accept chamber 34. The above is a simplified explanation of the operation of the cyclone separator which is more fully described in U.S. Pat. No. 3,800,942 of Reid et al issued Apr. 2, 1974 referred to previously.

Both the separator cone 38 and the vortex finder 70 are subject to high wear due to the abrasion of solid particles within the stock fluid. Therefore, these members are made of an abrasion resistant material including metal or ceramic material, such as aluminum oxide ceramic. In order to form seals between rigid cones of ceramic or metal and the mounting openings through the walls of the pressure chamber, previously separate resilient sealing rings have been provided. These sealing rings have been provided as rubber 0-rings or other gaskets of elastomer material between the rigid cone and the metal flanges surrounding the wall openings. However, this type of gasket sealing is extremely difficult when the wall openings are not in alignment, or when the cones are not made exactly symmetrical due to manufacturing tolerances and imperfections. The cyclone cone assembly of the present invention overcomes this problem by employing the cover sleeve 40 of plastic material which is provided with flexible seal regions 50, 52 and 54 in the sleeve. These flexible seal regions form high pressure seals with the wall openings in flanges 44, 46 and 48 even though the cone may be made in a non-symmetrical shape and the wall openings are not in exact axial alignment.

The method of manufacture of the cone assembly 10 is hereafter described. The cover sleeve 40 is molded of plastic and then bonded to the outer surface of the separator cone 38 by heating the cone to a temperature above the melting temperature of the plastic used for such sleeve. The heated cone is inserted into the sleeve and allowed to heat the inner surface of the sleeve above its melting temperature to melt such inner surface while they are thus assembled. Next, the assembly is allowed to gradually cool down to atmospheric temperature or is cooled rapidly by quenching in a cooling liquid such as water. When the cone is made of ceramic the quenching water may be at an elevated temperature of approximately 200° F. to prevent too rapid cooling which might cause sufficient thermal shock resulting in fracture of the ceramic cone. During cooling to atmospheric temperature, the plastic sleeve 40 is bonded to the cone 38. The terms "bonded" and "bond" as used herein refer not only to a chemical bond formed by melt bonding but also a mechanical bond formed by shrinkage of the cover sleeve 40 to provide a tight shrink fit with the cone 38, such as when the sleeve is made of nylon.

In the preferred embodiment the cover sleeve 40 is made of polyethylene plastic, such as low density linear polyethylene which has a melting temperatue of approximately 240° F. The cone 38 is made of aluminum oxide ceramic which is heated for approximately fifteen minutes to a temperature between 350° F. and 405° F., depending upon the wall thickness of the ceramic cone. The heated ceramic cone is then inserted into the polyethylene cover sleeve to melt the inner surface of the sleeve and then cooled. Upon cooling the assembly to room temperature, a chemical bond is formed between the polyethylene sleeve and the ceramic cone without the use of additional adhesive. In addition, the plastic sleeve shrinks to fit tightly onto the ceramic cone due to their different coefficients of thermal expansion to form a mechanical bond between the cone and the sleeve. In this manner, the sleeve is bonded to the cone to prevent them from separating by longitudinal movement or rotation and to prevent liquid or other foreign matter from passing between them. The wall thickness of the cover sleeve 40 when made of polyethylene plastic is approximately 0.150 inch which is slightly less than the wall thickness of the ceramic cone 38 which is approximately 0.200 inch thick in all areas of the cone except the thickened lip portion 64 where it is approximately 0.450 inch thick.

An annular stop flange portion 88 is molded into the outer surface of the cover sleeve 40 at the left side of the seal region 52 so that such stop flange extends outwardly about 0.100 inch beyond the sealing ridges 56. As a result, the stop flange 88 engages the chamber wall 26 in the area surrounding the mounting opening on the opposite side of the wall from the mounting flange 46. Thus, during mounting of the cone assembly the stop flange 88 limits the depth of insertion of the cone assembly into the mounting openings to the position shown in FIG. 2 to form the seals between the sealing ridges 56 and the flanges 44, 46 and 48.

As shown in FIG. 4, a pair of water inlet passages 90 of 0.234 inch diameter may be provided through the cover sleeve 40 and the wall of the cone 38 in the lower region of the cone between sealing regions 52 and 54 for connecting the interior of the cone with the water supply chamber 32 between chamber walls 26 and 29. Thus, water is injected through passages 90 into the cone 38 in a direction tangentially with the surface of the cone by the pressure within the water chamber to cause such water to spiral down the cone through the reject outlet opening 84 at the apex or small diameter end of the cone which is about 0.730 inch in diameter. This water injection helps to prevent clogging at outlet 84 and enhances the cleaning action of the cyclone. The pressure in the water chamber 38 is about 22.0 psi gauge or greater than the average pressure of about 20.0 psi gauge within the interior of the cone, which prevents the stock from leaving the cone and entering such water chamber through openings 90. Such water pressure is set sufficiently high to continuously inject a small amount of water into the cone for continuous cleaning of the outlet 84 by dilution of the stock solution at the small end of the cone.

Figure 6:
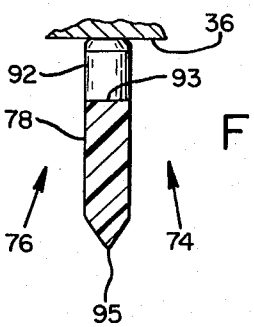
FIG. 6 is an enlarged horizontal section view taken along the line 6—6 of FIG. 5.
Figure 5:
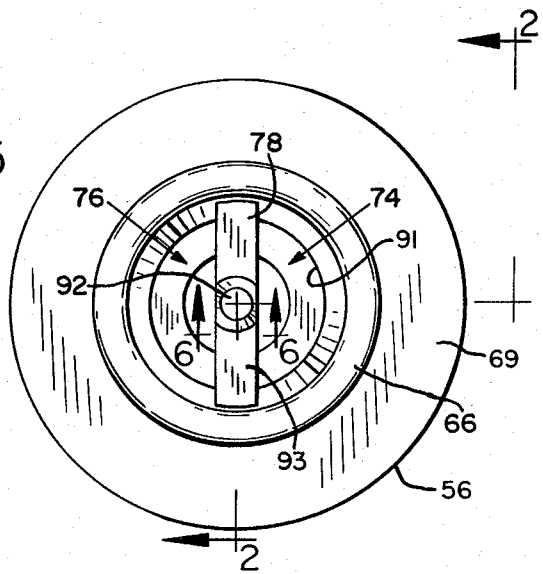
FIG. 5 is a side elevation view taken from the left side of the cone assembly of FIG. 2.

As shown in FIGS. 5 and 6, the plastic cap 66 on the large diameter end of the separator cone assembly is provided with the divider partition 78 in the interior cavity 91 of such cap. As a result, the light fraction material passing through the accept outlet 72 of the cone in axial alignment with the longitudinal axis 86 of the cone is discharged into the accept chamber 34 through the pair of cap outlets 74 and 76 which are not aligned with the axis of such cone, but are provided on opposite sides of the partition. The outer end of partition 78 is provided with an axial stop projection 92 extending outward which forms a stop for engagement with the outer chamber wall 36 as shown in FIG. 6. This enables the light fraction material transmitted through outlets 74 and 76 to pass over the top 93 of the partition 78 which is provided with a wedge-shaped bottom 95 for preventing stock build-up on the partition. Also, the cyclone separator cone assembly 10 is prevented by stop 92 from moving to the left out of the mounting apertures in the chamber walls 24, 26 and 29 by the cap stop 92 and is prevented from moving to the right out of such apertures by the sleeve stop 88 in engagement with the chamber wall 26. Of course, the separator cone 38 and the plastic sleeve 40 are prevented from movement relative to each other by the melt bond formed between such members during the method of manufacture described above.

It should be noted that the method of manufacture of the present invention is also applicable to bonding a plastic sleeve to any core member inserted into the sleeve provided such core member is of higher melting temperature than the sleeve. A solid core member of ceramic or metal can be used in place of the hollow cone. However, the second method is otherwise the same as that described above.

It will be obvious to those having ordinary skill in the art that many changes may be made in the details of the above-described preferred embodiments of the present invention without departing from the broad concept of the invention. Therefore, the scope of the invention should be determined by the following claims.

I claim:

1. Cyclone separator apparatus, comprising:

a hollow separator cone member of abrasion resistant ceramic material having a stock inlet through the wall of said cone member adjacent the large end of the cone of largest diameter, a first outlet at the small end of said cone and a second outlet at said large end spaced inward from said input, said cone member having a conical shaped portion for centrifugal separation of materials;

a vortex finder member of ceramic material closing the large end of the cone except for a restricted outlet passage which is of smaller diameter than the larger end of said cone to provide said second outlet;

a cover sleeve of plastic material covering the outer surface of said cone, said abrasiion resistant material being of greater hardness than said plastic material of said sleeve; and a plurality of flexible seal regions of plastic formed at longitudinally spaced positions in said cover sleeve including sealing projections provided on the outer surface of said seal regions, at least one of said seal regions being positioned radially outward and aligned with the outer surface of the cone.

2. Separator apparatus in accordance with claim 1 in which at least some of the seal regions are spaced from the outer surface of the cone.

3. Separator apparatus in accordance with claim 2 in which the plastic material is a thermosplastic.

4. Separator apparatus in accordance with claim 2 in which the plastic material is a polyethylene plastic material.

5. Separator apparatus in accordance with claim 1 in which the ceramic material is an aluminum oxide ceramic material.

6. Separator apparatus in accordance with claim 1 in which the inlet is positioned to direct liquid stock tangentially to the inner surface of the separator cone, said first outlet is located at the small end of said cone for discharging heavy fraction material in said stock, and said second outlet is located centrally of the large end of the cone for discharging light fraction material in said stock.

7. Separator apparatus in accordance with claim 1 in which the outlet passage extends through a cylindrical projection on the inner side of said finder member which is in axial alignment with the cone axis.

8. Separator apparatus in accordance with claim 1 in which the finder member is clamped between the large end of said cone and a cap member of plastic material attached to the large end of said sleeve.

9. Separator apparatus in accordance with claim 1 in which the sleeve is sealed by said sealing projections within a plurality of substantially aligned sealing openings provided in the walls of chambers of different pressure within said cyclone separator apparatus.

10. Separator apparatus in accordance with claim 9 in which the sealing openings are formed with cylindrical flanges extending substantially perpendicular to the walls, and said sealing projections form fluid-tight seals by engagement with said flanges even when said sealing openings or said seal regions are not in exact alignment prior to assembly.

* * * * *

UNITED STATES PATENT AND TRADEMARK OFFICE

CERTIFICATE OF CORRECTION

PATENT NO. : 4,539,105

DATED : September 3, 1985

INVENTOR(S) : Robert L. Metcalf

It is certified that error appears in the above-identified patent and that said Letters Patent is hereby corrected as shown below:

Insert in [56] under References Cited, U.S. Patent Documents after the last mentioned reference the following U.S. Patents:

| | | | |
|---|---|---|---|
| 3,034,647 | 5/1962 | Giesse | 209/144 |
| 3,348,683 | 10/1967 | Wikdahl | 210/84 |
| 3,486,618 | 12/1969 | Wikdahl | 209/144 |
| 3,486,619 | 12/1969 | Grundelius et al | 209/211 |
| 3,543,931 | 12/1970 | Rastatter | 209/211 |
| 3,747,306 | 7/1973 | Wikdahl | 55/349 |
| 3,800,946 | 4/1974 | Reid et al | 210/84 |
| 3,902,601 | 9/1975 | Townley | 209/144 |
| 3,959,123 | 5/1976 | Wikdahl | 209/211 |
| 4,053,393 | 10/1977 | Day et al | 209/211 |
| 4,309,283 | 1/1982 | Vikio et al | 209/211 |

UNITED STATES PATENT AND TRADEMARK OFFICE

CERTIFICATE OF CORRECTION

PATENT NO. : 4,539,105

DATED : September 3, 1985

INVENTOR(S) : Robert L. Metcalf

It is certified that error appears in the above-identified patent and that said Letters Patent is hereby corrected as shown below:

In The Specification:

Column 1, line 14, after "regions" first occurrence insert --.--

In the Claims:

Column 9, line 32, "one" should be --some--

Signed and Sealed this

*Seventeenth* Day of *December 1985*

[SEAL]

*Attest:*

DONALD J. QUIGG

*Attesting Officer*

*Commissioner of Patents and Trademarks*